United States Patent [19]

Albach

[11] 3,985,146

[45] Oct. 12, 1976

[54] DISPOSABLE SHAVING KIT

[75] Inventor: William N. Albach, E. Brunswick, N.J.

[73] Assignee: Lawrence Peska Associates, Inc., New York, N.Y. ; a part interest

[22] Filed: May 29, 1975

[21] Appl. No.: 581,790

[52] U.S. Cl. ..... 132/79 B; 30/41; 206/228

[51] Int. Cl.[2] ..... A45D 40/00

[58] Field of Search ..... 132/79, 80; 30/41.5, 30/43.6, 43.9, 43.92, 48, 86; 401/88, 126; 128/260; 206/228, 229

[56] References Cited

UNITED STATES PATENTS

| | | | |
|---|---|---|---|
| 2,632,446 | 3/1953 | Rosenzweig | 132/80 R |
| 2,998,684 | 9/1961 | Corey | 132/80 R |
| 3,703,765 | 11/1972 | Perez | 30/41 |
| 3,726,009 | 4/1973 | Hackmyer | 30/41 |

*Primary Examiner*—G. E. McNeill
*Attorney, Agent, or Firm*—Jack D. Slobod

[57] ABSTRACT

A disposable shaving kit includes a head portion which is a mass of plastic molded about a razor blade to root the blade in the head. The handle for the head is an elongated flexible tube member containing enough shaving cream for one shave. A plastic stem integral with the head passes through the center of the tube member to stiffen the member.

1 Claim, 5 Drawing Figures

DISPOSABLE SHAVING KIT

FIELD OF THE INVENTION

The present invention relates generally to combined razor holders and shaving cream dispensers. In its particular aspects the present invention relates to a razor holder portion which is a mass of plastic molded about a razor blade.

BACKGROUND OF THE INVENTION

Various toilette articles are presently provided in vending machines for use by travellers who have forgotten to pack such items. There is a need to provide for use with such vending machines a combined razor device and shaving cream dispenser which is sufficiently inexpensive as to be used for one shave and thereafter discarded. One attempt to fill the aforementioned need was the provision of a cardboard razor blade and shaving cream holder as shown in U.S. Pat. No. 2,019,957 to England. The device of England, since its disclosure in 1935, has not to my knowledge gained any substantial use. One reason for this lack of use, it is believed, is that the device, being constructed of cardboard, was rather delicate and easily deformed. Another problem with that device is that it could not hold the large amount of shaving cream which is used today for one shave since the volume of shaving cream held was restricted to the size of the handle.

OBJECTS OF THE INVENTION

It is an object of the present invention to provide a combined razor blade and holder therefor which is sufficiently inexpensive as to be disposable and which holder has sufficient strength so that the razor blade may be used in a natural manner.

It is a further object of the present invention to provide a combined razor blade holder and shaving cream dispenser, which dispenser is capable of holding sufficient shaving cream for one shave.

SUMMARY OF THE INVENTION

Briefly, the aforementioned and other objects of the present invention are satisfied by providing a combined razor blade holder and shaving cream dispenser which holder is sufficiently rigid as to be used in a natural manner. The holder includes a one piece head portion which is a mass of plastic material molded about a razor blade to embed the blade in the head. There is further provided an elongated handle including a cylindrical stem projecting integrally from the head which serves to stiffen the handle. The handle also comprises a flexible tube member surrounding the stem and filled with shaving cream.

The tube member may be of a size larger than is comfortably gripped so as to contain a large amount of shaving cream, because the walls of the tube member are deformed radially inward against the stem in order to dispense the shaving cream through an aperture in the tube member. Thus, after the shaving cream is dispensed the handle is of a reduced comfortably gripped diameter.

Other objects, features and advantages of the present invention will become apparent upon perusal of the following detailed description of the preferred embodiment thereof when taken in conjunction with the appended drawing wherein.

DETAILED DESCRIPTION

Figure 3:
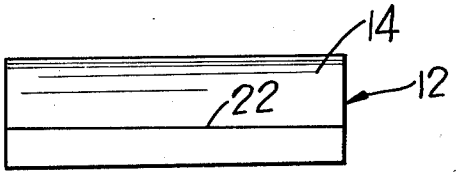
FIG. 3 is a top view of FIG. 1.
Figure 1:
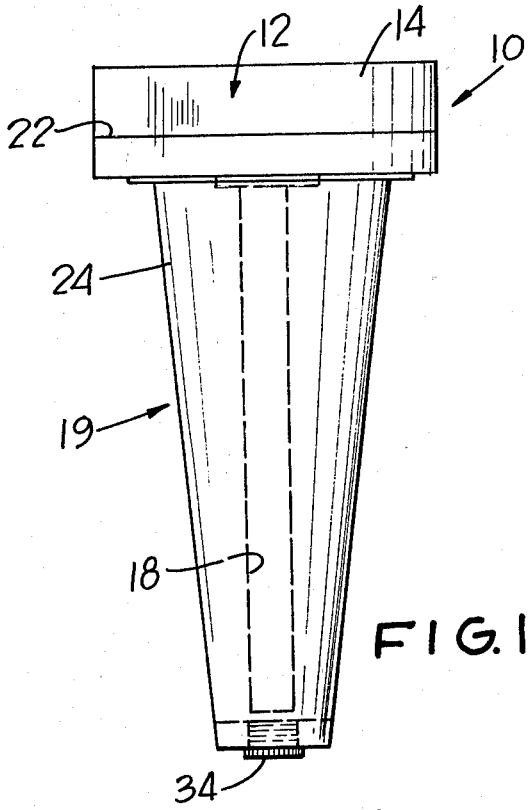
FIG. 1 is a front view of the shaving kit of the present invention.
Figure 2:
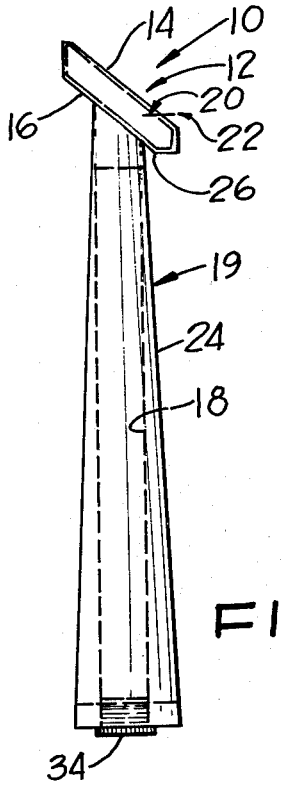
FIG. 2 is a side view of FIG. 1.
Figure 4:
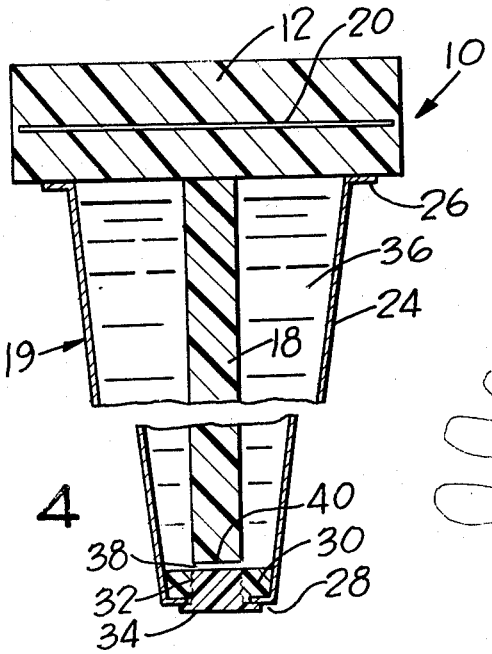
FIG. 4 is a view similar to FIG. 1 but in cross-section.

Referring to FIGS. 1 through 5 of the drawing, the disposable shaving kit 10 of the present invention comprises a one piece plastic head 12 having parallel rectangular top and bottom surfaces 14 and 16. An elongated cylindrical plastic stem 18 is formed integrally with head 12 and projects from bottom face 16 at an angle of approximately 45° and acts as a stiffener for a handle 19. A razor blade 20 is embedded into top surface 14 at an angle of approximately 45° and has a blade edge 22 projecting from and spanning the length of surface 14.

Handle 19 further includes, along the length of stem 18 and surrounding the stem, a thin walled flexible plastic tubular member 24. Member 24, which is preferably composed of polyethylene has a top end flattened into a rectangular cross-section which includes a radially outwardly directed circumferential flange 26 sealably secured to bottom surface 16 as by heat sealing. The bottom end of tubular member 24 is circular and is provided with a radially inwardly directed circumferential flange 28 capturing a plastic cylindrical plug 30 within tubular member 24. Cylindrical plug 30, which is secured to flange 28 as by heat sealing, further includes a threaded central bore 32 which receives a threaded cap 34 to close the bore 32.

The interior of flexible tubular member 24, as well as containing stem 18, is filled with shaving cream 36 in sufficient volume for one shave.

Figure 5:
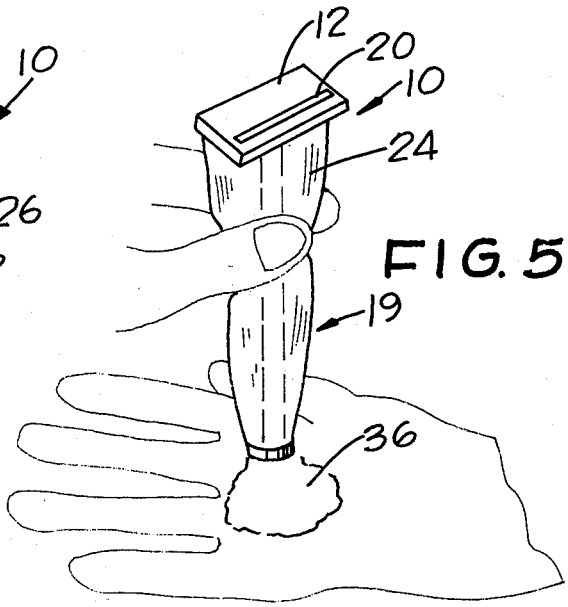
FIG. 5 is a pictorial presentation of the shaving kit of FIGS. 1 through 4 in use.

To dispense shaving cream 36, as shown in FIG. 5, cap 34 is unscrewed and the tubular wall of member 24 is deformed against stem 18 to squeeze the shaving cream 36 through a vertical space 38 between the free end 40 of stem 18 and the plug 30, and out bore 32 in the plug.

When all the shaving cream 36 is dispensed, the tubular wall of member 24 substantially conforms around stem 18, providing a rigid handle 19 for the head 12.

It should be understood that the tubular member 24 can contain quite a large amount of shaving cream, since its initial diameter can be larger than comfortably gripped prior to dispensing of the shaving cream. Once the shaving cream 36 is substantially fully dispensed, the handle 19 is of a reduced diameter substantially equal to the diameter of cylindrical stem 18.

To provide a shaving kit 10 which is so inexpensive as to be disposable, the head 12 comprises a one piece plastic mass such as polystyrene which is injection molded about blade insert 22 to root the blade in the head. The stem 18, being integral with head 12 is molded simultaneously with the head.

Having described the preferred embodiment of the present invention in detail, it should be apparent that numerous modifications, additions and omissions in the details thereof are possible within the intended spirit and scope of the invention. Accordingly, the following claims define the scope of the invention.

What is claimed is:

1. A shaving device comprising: a razor blade; a one piece head being a mass of plastic material molded about said razor blade to embed said blade in said head; an elongated stem integral with and projecting from said head; an elongated collapsible tube member surrounding said stem and forming a handle of said shaving device; said tube member having one end secured to said head, the opposite end of said tube member having a discharge aperture; shaving cream in said tube member and a closure means for said aperture, said shaving cream being dischargeable through said aperture in response to radially collapsing said tube member against said stem; said stem extending over substantially the entire length of said tube member for stiffening said handle.

* * * * *